United States Patent [19]

Lee

[11] 4,206,721

[45] Jun. 10, 1980

[54] RETAINER FOR MURINE SPECIMENS AND TEST EQUIPMENT

[76] Inventor: Roland W. Lee, 107 Chinkapin La., Williamsburg, Va. 23185

[21] Appl. No.: 946,993

[22] Filed: Sep. 29, 1978

[51] Int. Cl.[2] ..... A61D 3/00

[52] U.S. Cl. ..... 119/103

[58] Field of Search ..... 119/103; 269/328

[56] References Cited

U.S. PATENT DOCUMENTS

| | | | |
|---|---|---|---|
| Re. 24,377 | 10/1957 | Creelman | 269/328 |
| 928,657 | 7/1909 | Howell | 269/171.5 X |
| 1,089,283 | 3/1914 | Stebbins | 119/103 |
| 2,832,313 | 4/1958 | Toepel | 119/103 |
| 3,286,693 | 11/1966 | Clarke, Jr. et al. | 119/103 |
| 3,353,820 | 11/1967 | Langren | 269/328 |
| 3,973,522 | 8/1976 | Rosow | 119/103 |

FOREIGN PATENT DOCUMENTS

| | | | |
|---|---|---|---|
| 79150 | 1/1895 | Fed. Rep. of Germany | 119/103 |

*Primary Examiner*—Louis G. Mancene
*Assistant Examiner*—Robert P. Swiatek
*Attorney, Agent, or Firm*—Wallace J. Nelson; John R. Manning; Howard J. Osborn

[57] ABSTRACT

A device for immobilizing live animals to permit laboratory examination thereof. The device consists of a base plate to which guides and pins are attached, and with cantilever arms disposed on and rotatably and vertically movable relative to the pins. The specimen to be retained is placed on the base plate between a pair of guides, and the arm over these guides is lowered onto the specimen. Thus, the specimen is confined but not surrounded. Guides, recesses, and holes in the arms allow the attachment of various fixtures or instruments to the retained animal(s).

4 Claims, 1 Drawing Figure

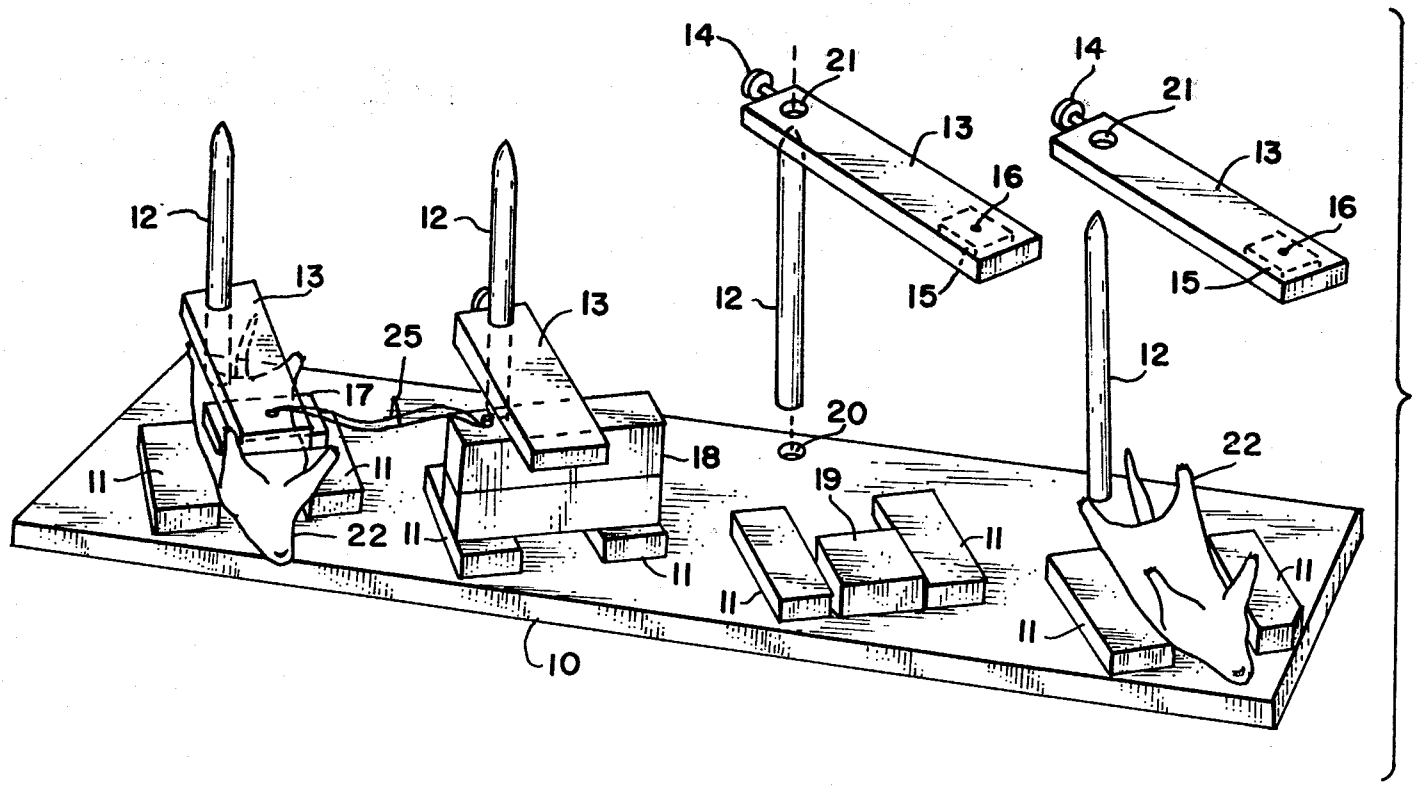
10
11
12
13
14
15
16
17
18
19
20
21
22
25

RETAINER FOR MURINE SPECIMENS AND TEST EQUIPMENT

ORIGIN OF THE DISCLOSURE

The invention described herein was made by an employee of the United States Government and may be manufactured and used by or for the Government for governmental purposes without the payment of any royalties thereon or therefor.

BACKGROUND OF THE INVENTION

Restraint mechanisms for laboratory experimental animals are widely used. A variety of restraining devices are commercially available. These are typically bridge-type apparatuses which restrict accessibility to the specimen. Furthermore, devices specialized to hold one species of animal (especially if intended for one size of the species) may hold the animal securely, but such devices are not versatile, and less specialized devices adaptable to many sizes may not hold any of them securely enough. The prior art does not make provision for holding test equipment such as electrodes or sensors adjacent to the specimen. There is, thus, a definite need in the art for a retainer more adaptable, flexible, and versatile in design.

Accordingly, it is an object of the present invention to provide a retainer which is adaptable to accommodate different kinds, sizes, and numbers of animals.

It is a further object of the present invention to provide a retainer which allows open access to the specimens.

It is yet another object of the present invention to provide a retainer with provisions for holding test equipment or sensors, or for attaching them to the animals.

SUMMARY OF THE INVENTION

The foregoing and other objects are attainable according to the present invention by providing a flexible design for a simple murine specimen retainer.

The preferred embodiment of the present invention consists of a base plate to which are attached guide blocks and pins with cantilever arms mounted on the pins. A specimen to be retained is clamped under a cantilever arm, against the base plate, with the guide blocks serving to prevent sideways motion.

In addition, the preferred embodiment of the present invention features guides, recesses and holes in the cantilever arm facilitating the attachment of a variety of equipment, electrodes, or sensors in proximity to the restrained animals.

The base plate is made arbitrarily large to accommodate a plurality of sets of guides, pins, and arms, these sets being small relative to the size of the specimen intended to be restrained, whereby access to the sides and ends of the specimen is free and convenient. The invention is therefore simultaneously practicable on a quantity of specimens and instruments.

A more complete appreciation of the invention and many of the attendant advantages thereof will be readily apparent as the same becomes better understood by reference to the following description when considered in connection with the accompanying drawing wherein:

BRIEF DESCRIPTION OF THE DRAWING

The FIGURE is a partially exploded perspective view of the preferred embodiment of the present invention, showing two of the arms and one of the pins removed, with exemplary attachments and two murine specimens in place.

DETAILED DESCRIPTION OF THE PREFERRED EMBODIMENT

The present invention consists of a base plate 10, to which a pair of parallel guide blocks 11 for each specimen are attached. Holes 20 secure pins 12 vertically in the base. Each of the pins 12 horizontally supports a cantilever restraining arm 13, through a hole 21 in the arm and of a diameter slightly larger than the pin. The length of the base plate 10, and the corresponding number of sets of guide blocks 11, pins 12, and arms 13 positioned on the base plate, are selected according to the requirements of the intended application.

The restraining function of the invention is accomplished by lowering arms 13 onto the item to be held, which may be either a murine specimen 22, or test equipment comprehensively designated 18. An important feature of the invention is its capacity to hold both a live specimen 22 and a sensor or electrode 17, together under one arm, as shown in the drawing at the left end of base plate 10. Test equipment 18 is connected to electrode 17 by test probe leads 25.

Once lowered, the arm may be held in place by the force of the compressed specimen pushing upward on the arm which tilts the free end of the arm up, whereby the bottom outer edge and top inner edge of hole 21 bind against pin 12, or the arm may be secured by the use of set screw 14.

At least some of the restraining arms 13 are fitted with a foam rubber cushion 15 which serves to spread the pressure of the arm on the specimen being held, thereby cushioning and holding the specimen more securely. The function of foam cushion 15 is duplicated by another foam cushion 19, mounted between the guides 11 and serving to contact and secure the underside of the specimen.

Depending upon the application intended for the invention, others of the restraining arms are provided with an opening 16 through which test probe leads 25 may be threaded. The pins 12 are of sufficient length to permit both a murine specimen 22 and sensor plates 17 to be held together under one arm.

Although the base plate 10, guide blocks 11, pins 12 and arms 13 of the preferred embodiment are fabricated from acrylic plastic, any suitable material may be utilized for construction thereof.

Although the invention has been described relative to a specific embodiment thereof, it is not so limited and numerous variations and modifications thereof will be readily apparent to those skilled in the art in the light of the above teaching. It is therefore to be understood that within the scope of the appended claims the invention may be practiced otherwise than as specifically described.

What is claimed as new and desired to be secured by Letters Patent of the United States is:

1. Apparatus for restraining murine specimens and test equipment for laboratory experimentation and the like, comprising:

a base plate;

clamping means attached to said base plate for releasably securing at least one murine specimen to said base plate, said clamping means including a vertically extending pin attached to said plate and a cantilever arm rotatably disposed and vertically movable on said pin and extending horizontally over and parallel to said base plate for securing a specimen to the apparatus;

lock means for fixedly positioning said cantilever arm relative to said base plate and said vertically extending pin;

cushioning means for securing said specimen and equipment between said base plate and said clamping means; and, a pair of rectangular guide blocks mounted on said base plate, said guide blocks being positioned with their respective longest axis on opposite sides of, parallel to, and equidistant from, a line extended radially from said pin, such that said cantilever arm will be above and parallel to said blocks when said arm is rotated into position to restrain a specimen.

2. The combination of claim 1 wherein said cushioning means is a pair of foam rubber blocks, the first of said pair being affixed to the underside of the said cantilever arm, the second of said pair being affixed to the said base plate between said guide blocks and directly beneath said first of said pair when said cantilever arm is in position to restrain a specimen, said cushioning means serving to contact the specimen and spread the pressure exerted thereon when a specimen is being restrained by said guide blocks, said cantilever arm and said base plate.

3. The combination of claim 1 wherein the sizes of said cantilever restraining arm and said guide blocks are small relative to the size of the specimen intended to be restrained, whereby access to the sides and ends of the specimen is free and convenient.

4. The combination of claim 3 wherein the set of the said pin, said cantilever arm, said pair of guide blocks and said cushioning means is repeated a plurality of times on the same base plate, such that a plurality of specimens and test instruments may be held simultaneously and in proximity, for laboratory experimentation.

* * * * *